US006363560B1

(12) United States Patent
Kesinger

(10) Patent No.: US 6,363,560 B1
(45) Date of Patent: Apr. 2, 2002

(54) CONNECTOR INSTALLATION AND REMOVAL TOOL

(76) Inventor: Donald A. Kesinger, 8206 S. Deercreek Canyon Rd., Morrison, CO (US) 80465

( * ) Notice: Subject to any disclaimer, the term of this patent is extended or adjusted under 35 U.S.C. 154(b) by 0 days.

(21) Appl. No.: 09/805,072

(22) Filed: Mar. 12, 2001

Related U.S. Application Data

(60) Provisional application No. 60/237,795, filed on Oct. 4, 2000, and provisional application No. 60/251,682, filed on Dec. 6, 2000.

(51) Int. Cl.[7] ..... B25F 1/00
(52) U.S. Cl. ..... 7/107; 7/138
(58) Field of Search ..... 7/107, 138; 29/751, 29/282, 238; 72/409.14; 81/347, 352–355, 361

(56) References Cited

U.S. PATENT DOCUMENTS 3,531,971 A * 10/1970 Robb et al. ..... 72/385
4,660,241 A * 4/1987 Chen et al. ..... 7/107
5,934,137 A 8/1999 Tarpill
6,182,541 B1 * 2/2001 Anderson et al. ..... 7/168

OTHER PUBLICATIONS

LEMCO, 1998 Tool catalog, pp. 4, 5; Lemco Tool, Cogan Station, PA.

* cited by examiner

*Primary Examiner*—D. S. Meislin
(74) *Attorney, Agent, or Firm*—Thomas W. Hanson

(57) ABSTRACT

A compact multi-function installer's tool which combines a linear compression tool for type F fittings with at least one of a security wrench, a trap wrench, and a hex socket wrench. The wrenches are preferably aligned with the central axis of the compression tool and the compression tool handle can be extended substantially perpendicular to the tool so that it operates as a single sided T handle for the wrenches, increasing the amount of torque which can be applied. Ideally at least two of the wrenches are included in the tool. The seat for the compression tool is preferably combined with one of the wrenches, sharing the end of the tool and the clearance slot therein. In one embodiment, the body of the tool is generally cylindrical and the compression tool handle recesses at least slightly into the body, so that the body functions similarly to a conventional nut driver handle, for ease of use.

17 Claims, 10 Drawing Sheets

CONNECTOR INSTALLATION AND REMOVAL TOOL

CROSS-REFERENCE TO RELATED APPLICATIONS

This application claims the benefit of U.S. Provisional Applications No. 60/237,795 filed Oct. 4, 2000 and No. 60/251,682 filed Dec. 6, 2000.

FIELD OF THE INVENTION

The present invention relates to devices for installing fittings on coaxial cable and for attaching fittings and traps. More specifically the invention relates to devices for installing those fittings requiring linear compression of the fitting. Even more specifically, the invention relates to combination tools which perform the linear compression function as well as serving as a trap wrench, security sleeve wrench, or other type of wrench needed by a cable installer.

BACKGROUND OF THE INVENTION

Transmission cable and related equipment for the cable television and similar communication industries form an increasingly large and complex infrastructure. Maintenance and expansion of this infrastructure requires significant expenditure of time and effort, primarily by service technicians working in the field. These technicians are often called upon to perform their work in cramped quarters, away from their vehicle, or at the top of a utility pole. These working conditions drive the technicians to use the smallest number of tools possible to reduce the weight and bulk which they have to carry.

Much of the work of a service technician in the field involves installing fittings onto coaxial cable, coupling these fittings to and de-coupling them from various items of equipment and installing components such as signal traps to establish the correct service for an end user.

The fittings used have been substantially standardized as a type F connector, but are continuing to evolve in how they are attached to the cable. Older fittings which utilized a radial crimp for connection are giving way to a fitting having two major sub-assemblies and requiring linear compression to force a sleeve into the body of the fitting. This is especially true where a watertight seal is desired. The fittings are then attached to equipment or components using a threaded coupling with a hex nut.

Where it is necessary to discourage tampering, the end of the cable, and the fitting, may be enclosed in a security sleeve. This sleeve is elongated and closely fitted, leaving only a narrow gap around the fitting. The end of the sleeve fits between the fitting and the component to which it is attached, retaining the sleeve in position until the fitting is removed. The configuration of the sleeve, in combination with the cable protruding from the sleeve precludes the use of conventional tools to attach or detach the fitting. Typically, a security sleeve wrench is used which is a thin walled socket of the correct size which has been slotted along one side to allow it to be placed over and around the cable, within the security sleeve, to engage the nut on the fitting.

One of the commonly used components in a cable television system is a signal trap. This blocks signals in a particular frequency range, controlling access to services using those frequencies. Typically, these traps are configured to use a spanner wrench consisting of a pair of pins received by matching holes in the end of the trap. Typically these holes are positioned on opposite sides of a protruding male fitting designed to couple with an F connector on a cable.

Even with the level of standardization present within industries such as cable television, a service technician requires ready access to a variety of tools adapted to the fittings and components typically encountered. As a minimum, this set of tools would typically include a compression tool for installing F connectors; a security sleeve wrench; a trap wrench; and a heavier duty slotted socket for removing fittings. The second socket is required because the thin-walled security sleeve wrench is too weak for regular use, especially if jammed or corroded fittings are encountered. In the industry, each of these tools is available as a discrete tool. Trap wrenches and security sleeve wrenches have been combined into a single, double ended tool. These combinations often use a knurled cylindrical body designed for gripping by hand. Unfortunately, this design does not provide the torque necessary to free a stuck fitting.

The stand-alone compression tools available are relatively bulky (often twice the width of a trap or security sleeve wrench) and suffer performance problems. The design of these tools is not suitable to being combined with a wrench because their size and shape does not allow them to be rotated in close quarters. One common problem is that of the connector being cocked at an angle to the compression tool when the connector is compressed. This is sufficiently common that at least one manufacturer includes a warning in the instructions for the tool to verify the alignment prior to compression. Misalignment can result in damage to either or both of the fitting and the tool and can result in a poor connection, resulting in a failure to achieve a water tight connection or in a loose connection to the cable which may later fail.

There is a need for a combination tool which reduces the number of individual tools which the technician needs to carry and which reduces the total weight of tools necessary to perform the same functions. Preferably this tool would combine the linear compression tool with at least one of the trap wrench and the security sleeve wrench, more preferably both. Ideally the combined tool would combine both trap and security sleeve wrenches with a compression tool, and would do so in a single unit only slightly larger than a conventional combined trap and security wrench and weighing less than the tools which it replaces. It would be desirable if this tool could further incorporate a heavier duty hex socket wrench than the security sleeve wrench and provide a means of applying significant torque to this wrench to deal with stubborn fittings. The compression portion of the tool would ideally provide improved alignment of the fitting to the tool to reduce or eliminate fittings which are misaligned during the compression process.

SUMMARY OF THE INVENTION

The present invention is directed to an apparatus for installing connectors to coaxial cable and for connecting them to and disconnecting them from other components for equipment.

According to the invention there is provided a linear compression tool combined with one of: a trap wrench, a security sleeve wrench or a hex socket wrench. The handle of the compression tool also functions as a cross handle for the wrench. More than one of the wrenches may be provided.

According to an aspect of the invention the wrench(es) may be removable allowing them to be replaced or interchanged with a different size or combination of wrenches.

According to another aspect of the invention the wrench (es) may be all aligned along the central axis of the compression tool.

Further in accordance with the invention the compression tool seat may be beveled to assist in aligning the fitting for compressions, with the bevel extending in excess of 180 degrees around the seat for improved alignment. The seat may be replaceable separately or in combination with one or more of the wrenches.

The advantages of such an apparatus are that a single tool may be carried by a technician which replaces two or more common tools. This reduces both the weight and the size of the tools which must be carried. With the correct combination of wrenches and compression tool, a single tool may serve for all tasks to be performed in a typical installation or repair. In addition, the compression tool uses a beveled seat with improved alignment for fewer problems with fitting compression.

The above and other features and advantages of the present invention will become more clear from the detailed description of a specific illustrative embodiment thereof, presented below in conjunction with the accompanying drawings.

DETAILED DESCRIPTION OF THE INVENTION

The following discussion focuses on the preferred embodiment of the invention, in which the tool is specifically adapted for use with type F connectors as they are used in the cable television industry. However, as will be recognized by those skilled in the art, the disclosed apparatus is applicable to a wide variety of situations in which a combination tool for use with similar cable or wire fittings is desired.

Glossary

The following is a brief glossary of terms used herein. The supplied definitions are applicable throughout this specification and the claims unless the term is clearly used in another manner.

F-connector—a widely used coaxial connector style used with coaxial cable such as RG-6, RG-11, and RG-59. The inventive tool is usable with other types of connectors with only minor dimensional changes and the invention is not restricted to or dependent upon this particular connector. Herein, the term F-connector or connector should be understood to encompass any of the similar connectors.

Security sleeve—an elongated close fitting sleeve which substantially encloses and is retained by a connector. The fitting is accessible only from the end of the sleeve from which the cable protrudes. This arrangement precludes the use of conventional tools to remove the fitting and thus discourages tampering. The fitting is usually installed and removed by using a security sleeve wrench.

Security sleeve wrench—a specially configured wrench which is adapted to access a fitting positioned within a security sleeve. This wrench is thin walled, to fit between the fitting and the sleeve, and incorporates a lengthwise clearance slot so that it can be placed over the cable within the sleeve.

Spanner—generally a wrench consisting of a pair of parallel pins adapted to be inserted into a matching pair of holes in the part to the rotated. Herein, this is generally used as a trap wrench and may be referred to as such.

Preferred Embodiment

The disclosed invention is described below with reference to the accompanying figures in which like reference numbers designate like parts. Generally, numbers in the 200's refer to prior art elements or elements in the surrounding environment while numbers in the 100's refer to elements of the invention.

Overview

Figure 1:
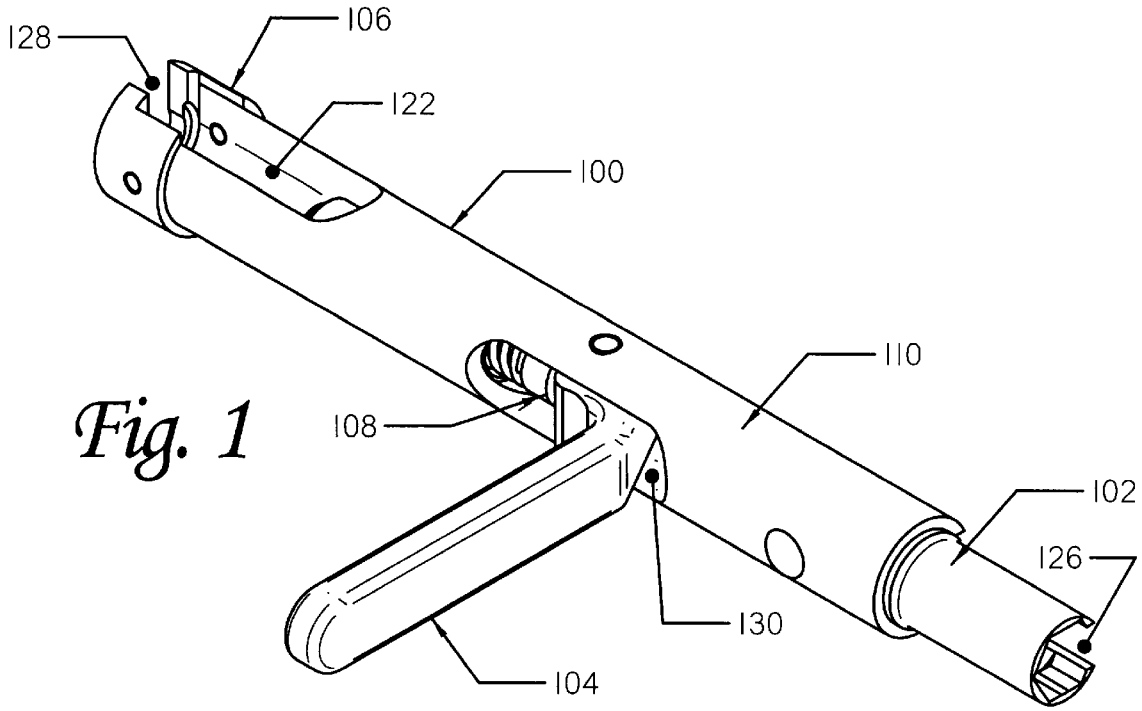
FIG. 1 is a perspective view of the preferred embodiment of the tool with the handle in the open position.
Figure 2:
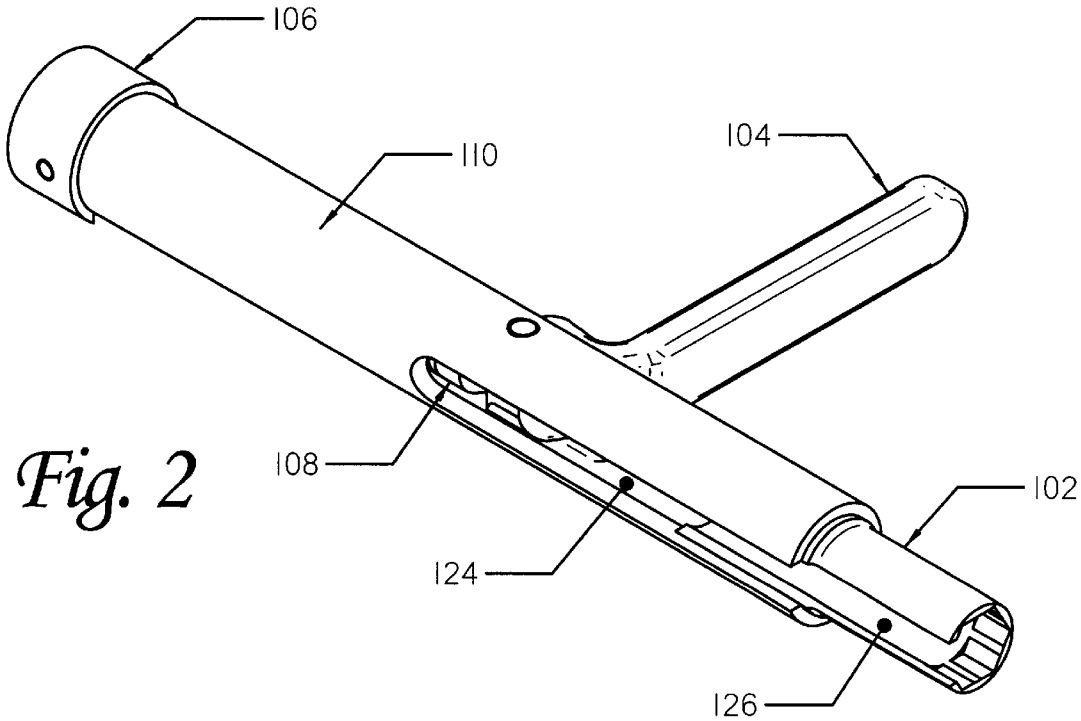
FIG. 2 is a perspective view showing the reverse side of the tool.
Figure 3:
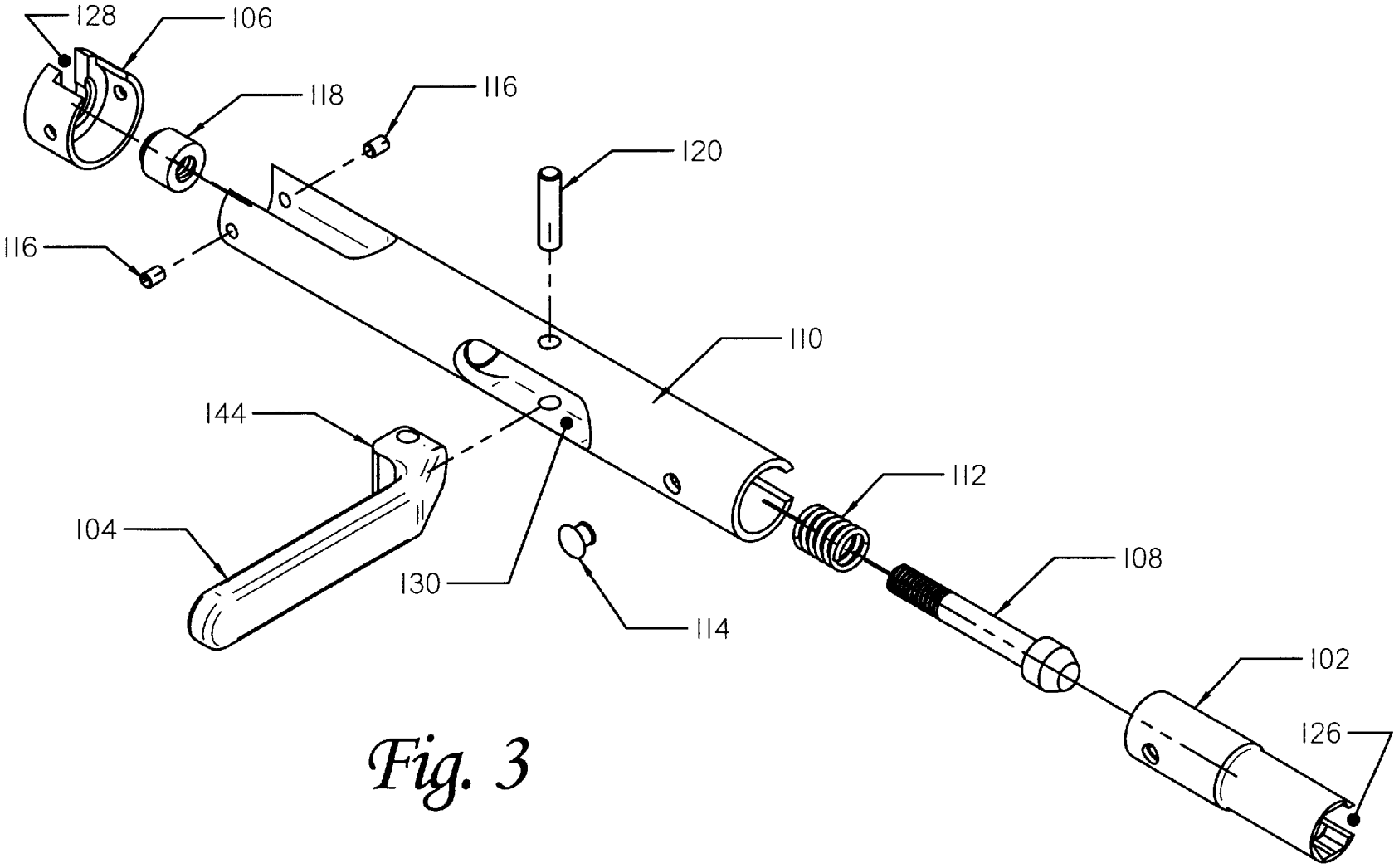
FIG. 3 is an exploded view of the preferred embodiment showing the various parts.
Figure 4:
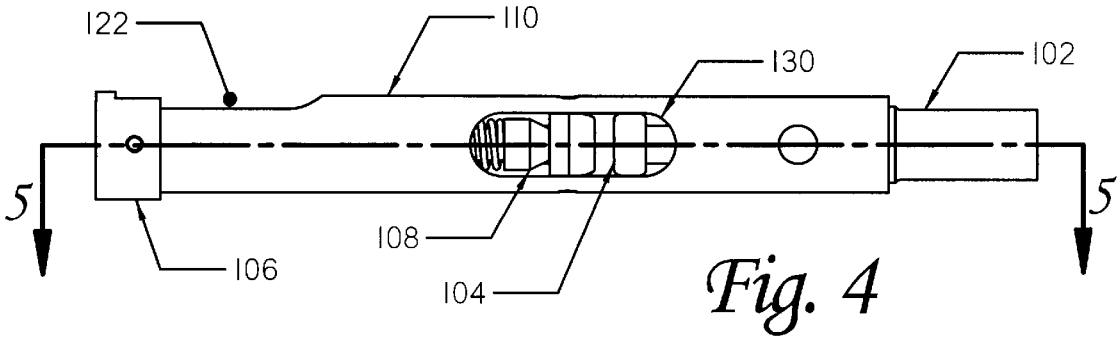
FIG. 4 is a front view of the tool, handle open.
Figure 5:
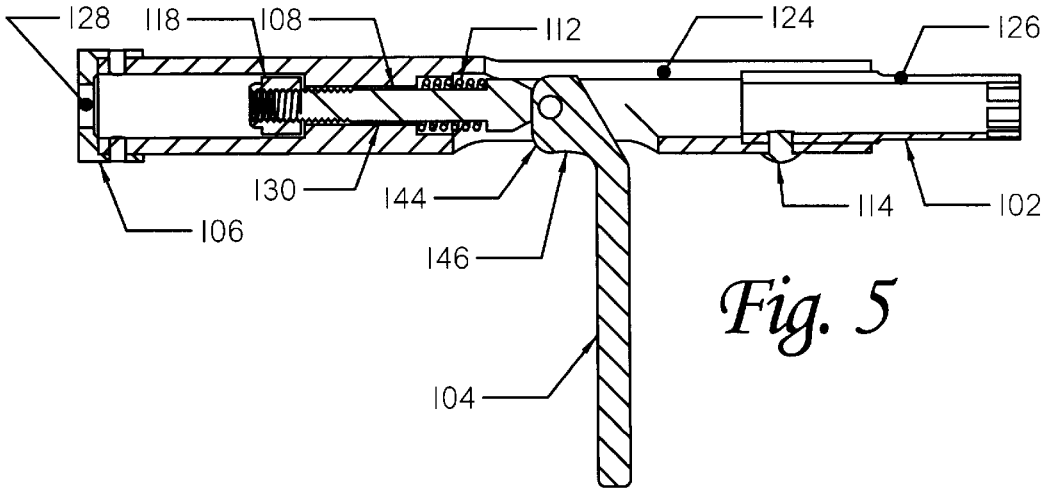
FIG. 5 is a cross section through the tool, handle open.
Figure 6:
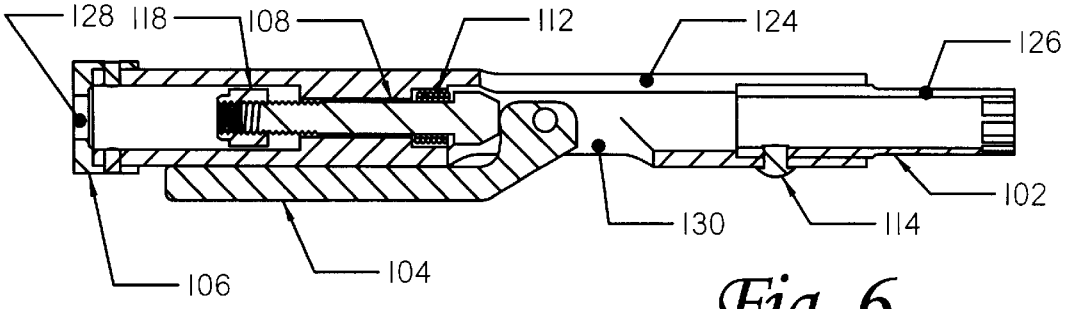
FIG. 6 is a cross section through the tool, along the same line as FIG. 5 with the handle closed.
Figure 7:
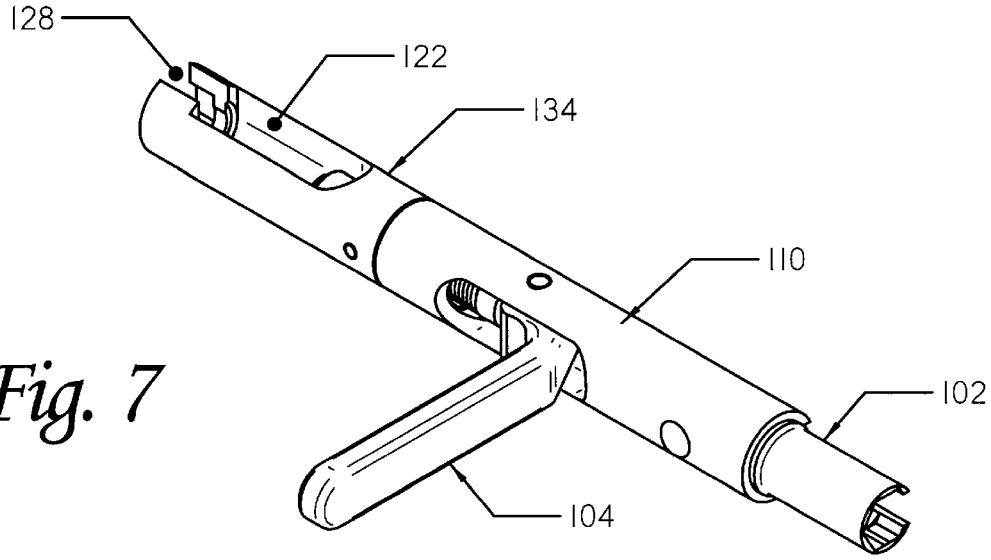
FIG. 7 is a perspective view of an alternative embodiment incorporating an extended end cap.
Figure 8:
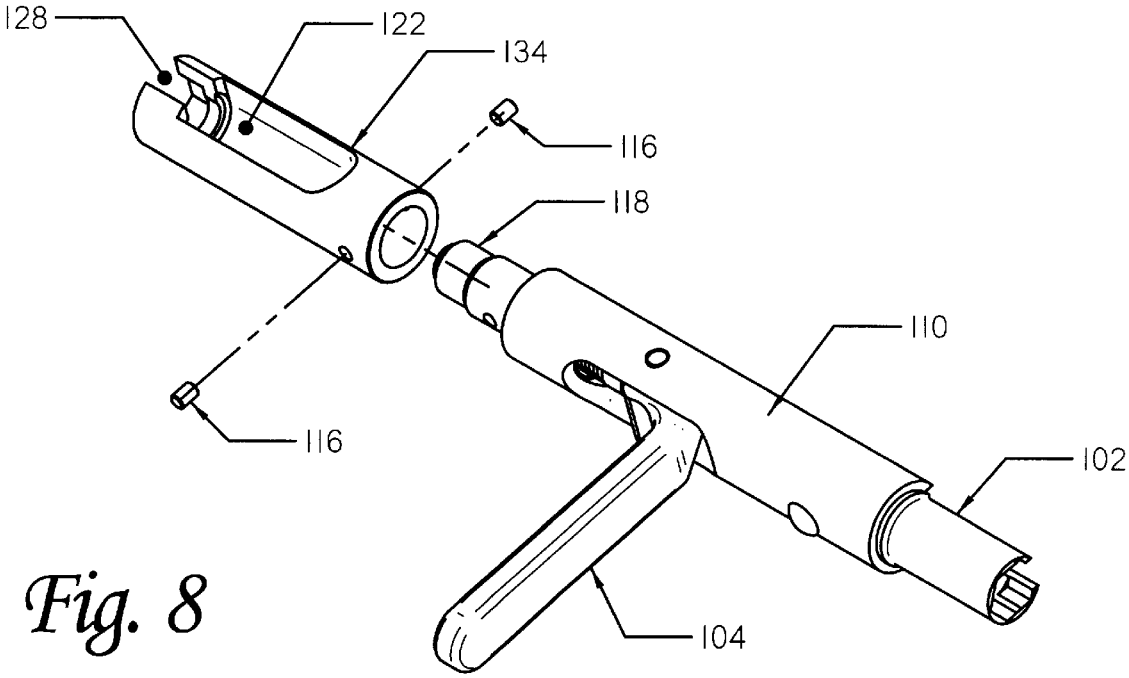
FIG. 8 is a partial exploded view of the embodiment of FIG. 7 illustrating the attachment and fit of the extended end cap.

Referring to FIGS. 1 & 2 the general structure of the inventive tool, 100, can be seen. The preferred embodiments combine a linear compression tool of the type usable with snap fit connectors with at least one other tool needed by cable installers. This may be a security sleeve wrench, 102; a trap wrench; a hex wrench; or a combination of more than one of these. Each of these tools is adapted to be placed over a fitting while it is in place on a cable, a capability not present in conventional tools, although known in the cable industry. The compression function of the tool utilizes an activating handle, 104, which activates the plunger, 108, to provide the linear motion required to compress the fittings. The handle, when positioned to extend outward from the body of the tool, also serves as a lever, enabling the user to apply increased torque to the wrench(es).

In the preferred embodiment, a multi-piece assembly is used to implement the inventive tool. In FIGS. 1 & 2, the end cap, 106, body, 110, and security sleeve wrench, 102, are separate pieces which are then joined together using pins, rivets, or any other suitable method. This allows an optimal selection of materials for each piece and may simplify some machining operations. For example, the body can be made of aluminum (either machined or cast) for light weight; the security sleeve wrench made of steel for sufficient strength in a thin wall configuration; and the end cap cast out of iron or other metal for rigidity and low cost. Clearly the same tool could be made with these three components formed in a single piece. For these aspects of the invention, unitary and multiple part construction are considered to be equivalent and both methods of construction are anticipated. Similarly, the various methods of interconnecting the components such as pins, set screws, threaded coupling, welding, adhesive bonding and other well known techniques, as appropriate to the materials used, are considered equivalent and interchangeable.

Structure

Figure 22:
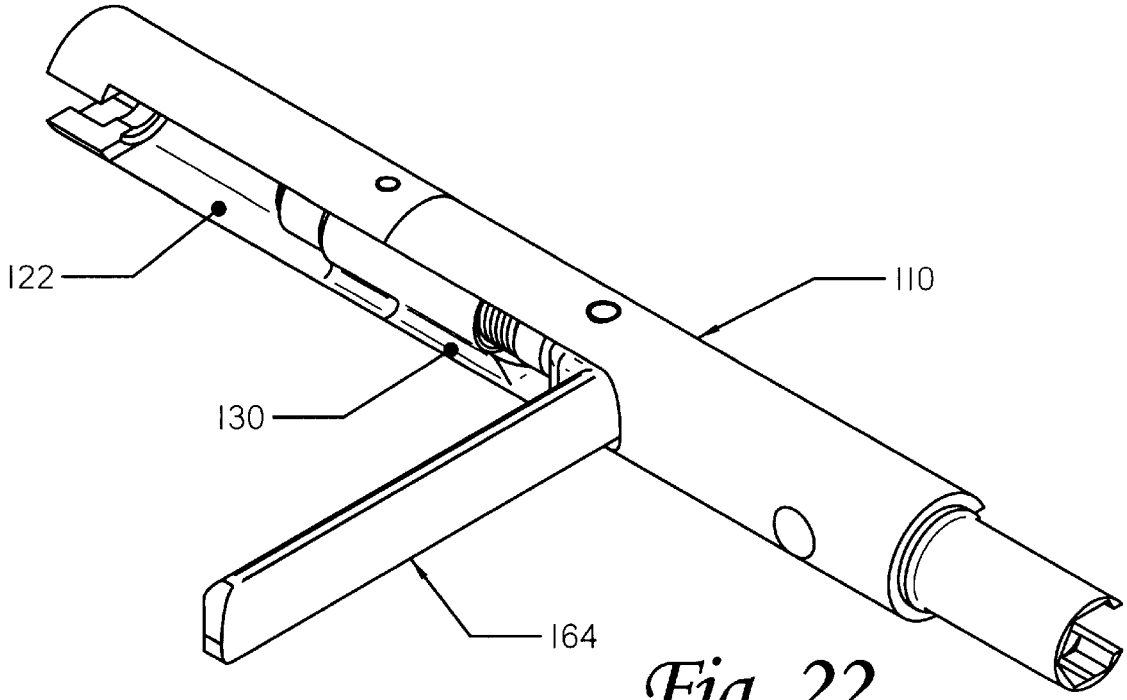
FIG. 22 is a perspective view of an alternative using a recessed handle, with the handle open.
Figure 23:
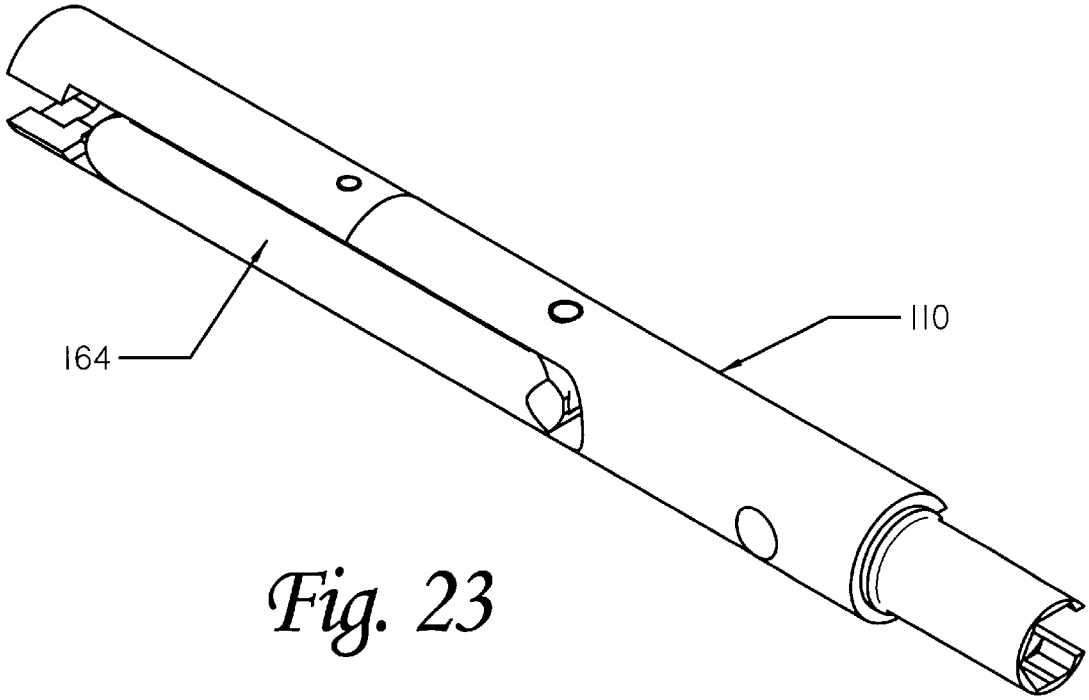
FIG. 23 is a perspective view of an alternative using a recessed handle, with the handle closed.

Referring to FIGS. 3–6 the various components and their interrelationships can be clearly seen. The body, 110, provides the primary structure to which the other components attach and defines openings, cavities, and passages which enable the operation of the various features of the tool. The body is preferably cylindrical to provide a compact yet strong tool. This shape is optimal for access to fittings which may be installed in close proximity to each other or to other equipment. Conventional compression tools are noticeably larger and often have a rectangular profile which would interfere with rotation of the tool in close quarters to operate an attached wrench. Opening, 122, allows for the fitting to be inserted and aligned with the compression plunger. It aligns with the corresponding opening, 128, in the end cap and allows the tool to be positioned over a fitting which is in place on a cable. Opening, 122, is sized to be at least somewhat larger that the maximum outside diameter of the largest fitting with which the tool is designed to be used. In a similar fashion, opening, 124, aligns with opening, 126, in the side of the security sleeve wrench, 102, and provides clearance for a cable on which a fitting is positioned. It is typically narrower than opening, 122, because it only has to clear the cable itself, not the fitting, and is relatively long to allow access to a fitting which is recessed within a security sleeve. Opening, 130, receives the handle for the compression component of the tool. If desired, openings 130 and 122 can be aligned and merged, forming a slot extending from the handle to the end of the cap, see FIGS. 22 & 23. With modifications to the handle, 164, it would fit into the slot in the closed position substantially flush with the surface, or at least recessed, for a more compact tool. Simultaneously, the recessed handle fills in the slot, providing a smooth handle. In this configuration the body of the tool would look, and could be used much like the handle of a conventional screwdriver or nut driver, with no interfering protrusions. This also slightly decreases the likelihood of interference with nearby equipment or other close fitting connections as might be encountered in a multi-line tap.

Figure 12:
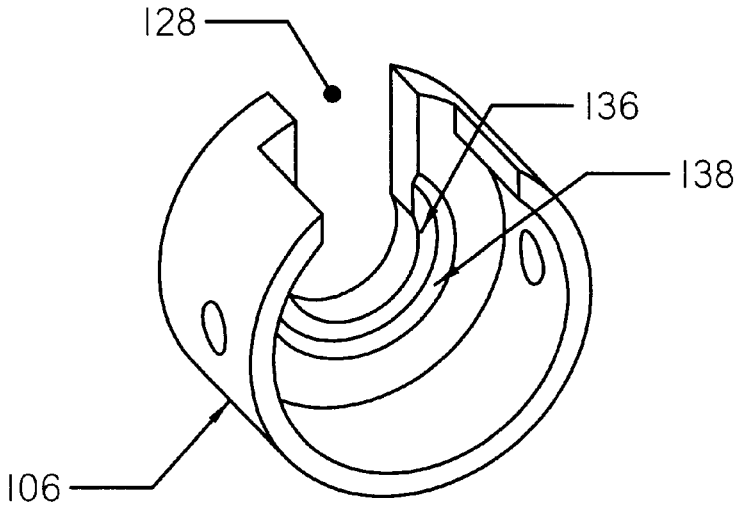
FIG. 12 is a detailed view of the inside of the preferred embodiment of the end cap, showing the beveled recess for the seat.
Figure 13:
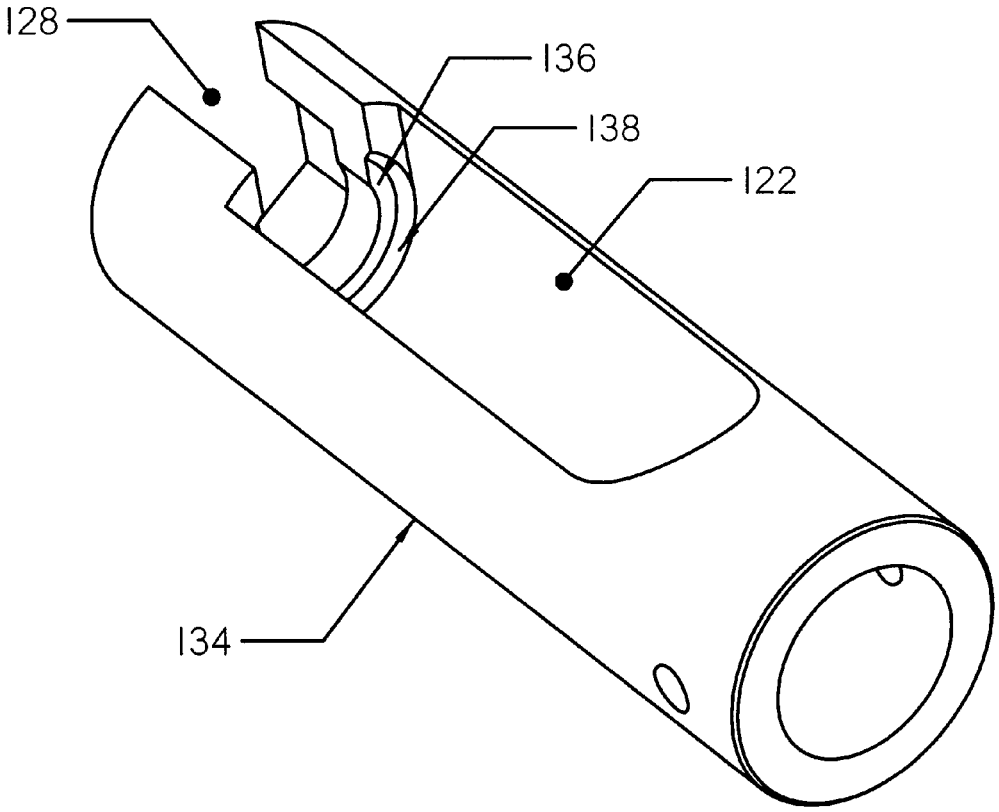
FIG. 13 is a detailed view of an alternative end cap showing the beveled recess.

The end cap serves primarily as a seat for the compression component of the tool. In the preferred embodiments the cap may be an external piece, 106, fitted to the end of the tool, see FIGS. 1–6, or it may form the entire end of the tool, 134, FIGS. 7–11, and incorporate the if channel, 122, for the cable. In either form, the cap may be retained by pins, 116, rivets, set screws, threads, or any other suitable means. As discussed above, the cap may also be integral with the body of the tool. Slot, 128, allows the cable, with fitting in place, to be inserted from the side of the tool. Seat, 136, supports and restrains the end of the fitting during compression. Note that the seat is positioned at the bottom of a shallow, beveled well, 138, (best shown in FIGS. 12 & 13) which preferably extends more than 180 degrees around the seat. This extended well aids in aligning the fitting with the seat and thus with the compression plunger to assure proper compression of the fitting. In the preferred embodiment, the slot is somewhat keyhole shaped with a slightly larger hole centered on the seat and a slightly larger gap providing access for the cable.

Figure 9:
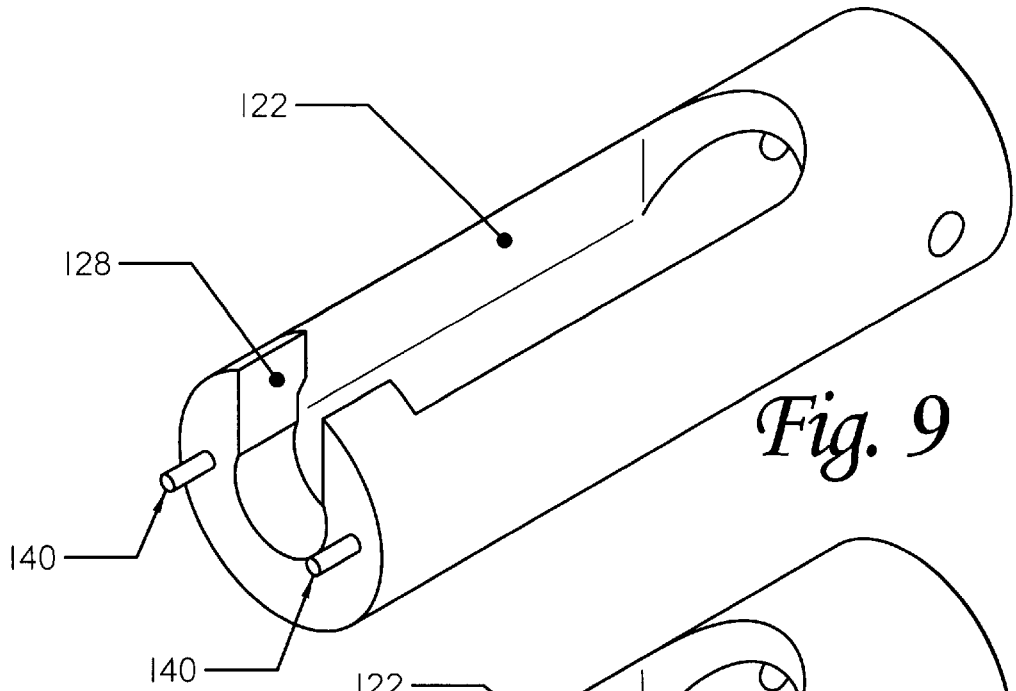
FIG. 9 illustrates an alternative embodiment of the end cap incorporating a trap wrench.
Figure 10:
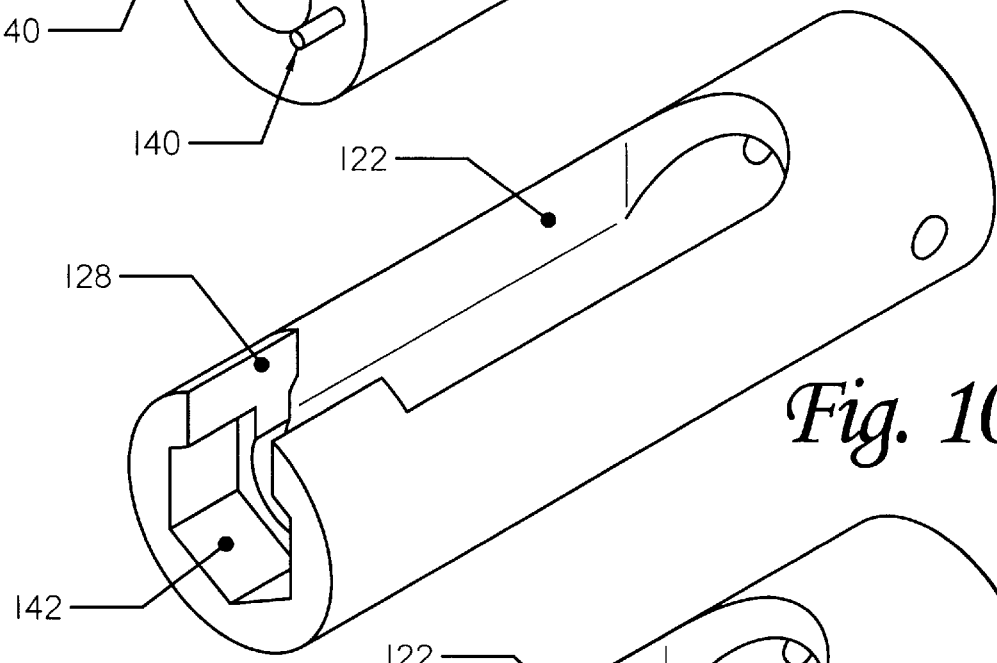
FIG. 10 illustrates an alternative embodiment of the end cap incorporating a hex socket wrench.
Figure 11:
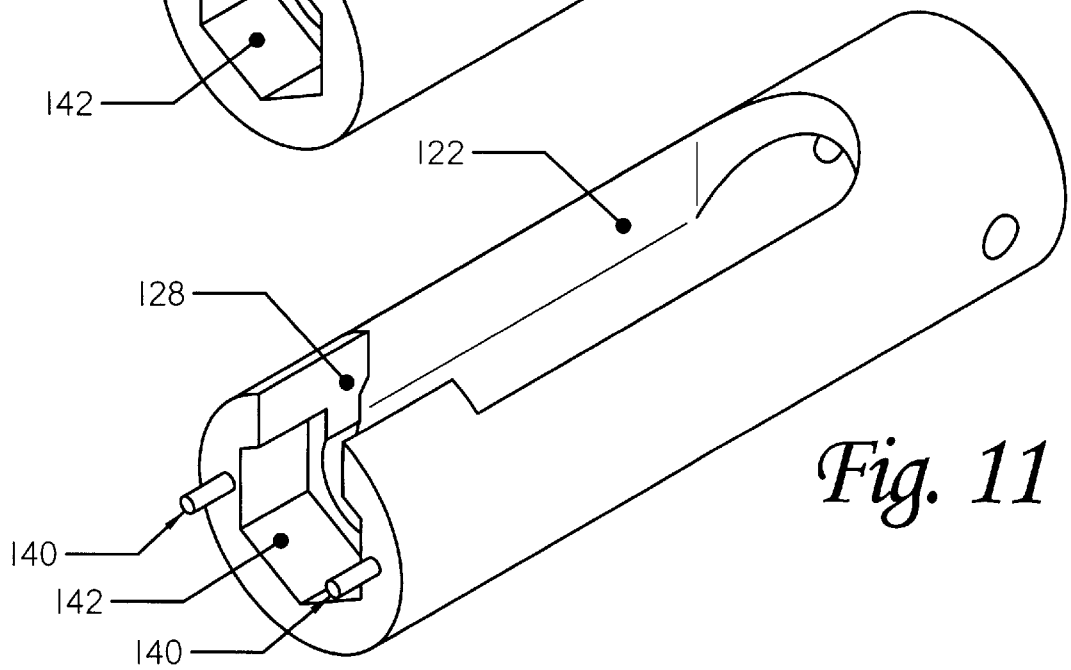
FIG. 11 illustrates an alternative embodiment of the end cap incorporating both trap wrench and hex socket wrench.

While the primary purpose of the end cap, 106, is as a seat for the compression component of the tool, it is readily configured to serve additional roles. These are most clearly illustrated in FIGS. 9–11 which show alternative embodiments of the extended version of the end cap, but are clearly applicable to all forms. FIG. 9 illustrates the basic cap with the seat and slot, 128, for fitting compression combined with the pins, 140, which form a spanner, or trap wrench, on the end of the cap. The slot also provides clearance so that the trap wrench may be positioned over a protruding male fitting on the trap. FIG. 10 illustrates the basic cap combined with a hex socket, 142, formed in the end of the cap. This socket would typically be sized to fit the hex collar of the fitting which the tool is also configured to compress. This is typically the same size as that of the security sleeve wrench at the opposite end of the tool, but substantially stronger. While the security sleeve wrench must necessarily be thin walled, limiting its strength, the socket formed in the end cap has no such limitation and can be made with very heavy walls for significant strength, while slot, 128, still allows placing the wrench over a fitting attached to a cable. The heavy walls of this socket, combined with the leverage provided by handle, 104, in its perpendicular position, allow the user to provide significantly higher torque to a fitting. This may be necessary where a fitting has become corroded or damaged. As FIG. 11 illustrates, both the hex socket, 142, and trap wrench, 140, can be combined with the compression seat in a single end cap, significantly increasing the flexibility of the tool. If desired, the end caps may be designed to be user replaceable. This would simplify the task of adapting the tool to use with a different size of compression fittings or to replace when worn. Where the end cap also incorporates a hex socket, one change will provide both a new seat and socket appropriate to the fitting.

Referring again to FIGS. 3–6, the security sleeve wrench, 102, is generally a thin walled hex socket with a slot, 126, cut in one side. The thin walls allow the socket to fit between a fitting and the walls of a security sleeve. The slot aligns with slot, 124, in the body of the tool and allows tool to be placed over the cable attached to the fitting. The tool can then be operated like a conventional security sleeve wrench to loosen or tighten the fitting. By extending the handle, 104, away from the tool, preferably substantially perpendicular, the user can increase the torque which can be applied to the fitting significantly beyond that which can be applied by a conventional security sleeve wrench. As with the external cap, the hex socket formed in the security sleeve wrench is sized to match the fitting with which the tool is designed to be used. If desired the security sleeve wrench can be user replaceable to make the tool adaptable to various sized fittings or for replacement when worn.

The compression component of the tool comprises the plunger, 108, return spring, 112, head, 118, and handle, 104, in addition to the seat formed in the external cap as discussed above. These parts are seen most clearly in FIGS. 5 & 6. The plunger is closely received in sleeve, 132, which is formed in the body of the tool. The plunger is free to move linearly within this sleeve in response to the actions of the handle and the return spring. Preferably the plunger and head are either hollow or have a recess in the end nearest the external cap to accommodate the center conductor of the coax cable which protrudes through the connector.

The handle pivots on pin, 120, and has an integrally formed eccentric cam, 144, which acts on the end of the plunger. In the extended position, FIG. 5, the plunger bears on the smallest portion of the cam and the head is at its fully retracted position. As the handle rotates to the closed position, FIG. 6, the cam forces the plunger toward the end of the tool, moving the head to its fully extended position. This motion compresses a fitting placed within the cavity formed by slot, 122, and the end cap, as discussed more fully below. The return spring applies a biasing force on the plunger to maintain it in contact with the cam and to retract it from the cavity when the handle moves to the open position. Optional detent, 146, in the handle serves to hold the handle in the fully closed position for storage.

The head is threadedly attached to the plunger to allow for adjustment of its position relative to the seat in the end cap. This adjustment allows for variations in the length of the fittings being compressed; regulates the maximum pressure which can be applied to the fitting by adjusting the closest approach of the head to the seat; provides for adjustment of the handle to suit individual user preference for amount of free play and the angle of the handle at full compression of the fitting, and to adjust for wear. This adjustment is significant because it allows the stroke of the tool to be closely matched to the minimum range needed to compress the fitting. Without this adjustment, the tool would require a larger stroke to accommodate the full range of variation in fitting sizes. If desired, the head may incorporate a screwdriver slot in the outer end, accessible through the end of the tool, for adjustment of the head position. A slot, or flat, may also be formed in the plunger to receive a flat screwdriver blade to prevent rotation of the plunger when the head is turned. If desired, either the head or the plunger may incorporate a nylon insert, or similar mechanism, to prevent unintended movement of the head relative to the plunger, thus maintaining a set position. Preferably, the head comprises a slightly tapered, truncated cone designed to be closely received within the end of the fitting, thus centering the fitting on the head. The lip of the fitting then rests on the shoulder portion of the head.

As discussed below, alternative embodiments of the compression component may utilize a roller on the plunger; a more pronounced cam profile; or a link in place of the camming action of the handle. As discussed above, the handle in its extended position also serves as a gripping handle to aid in rotation of the tool when using the wrenches configured at either end. This is a significant advantage over conventional trap or security sleeve wrenches which are generally relatively narrow cylinders with diameter only slightly larger than the wrenches themselves. While suitable for new, optimal fittings, conventional wrenches are inadequate for loosening corroded, damaged, or stiff connections.

Operation

Figure 17:
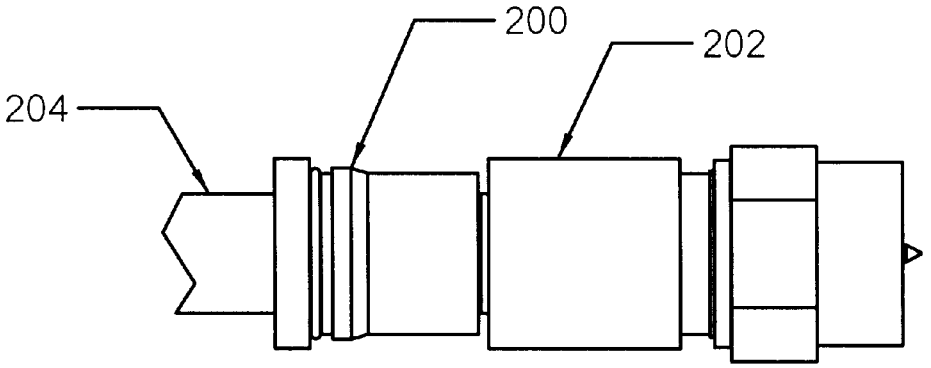
FIG. 17 is an illustration of a typical fitting of the type used with the tool.

The compression component of the inventive tool is designed to compress F connectors of the type shown in FIG. 17. As delivered to an installer, the connector comprises the sleeve, 200, and body, 202, sub-assemblies. These are slipped into place on a coax cable, 204. The compression function of the tool is then used to force the sleeve into the body of the connector, locking the fitting in place on the cable.

Figure 18:
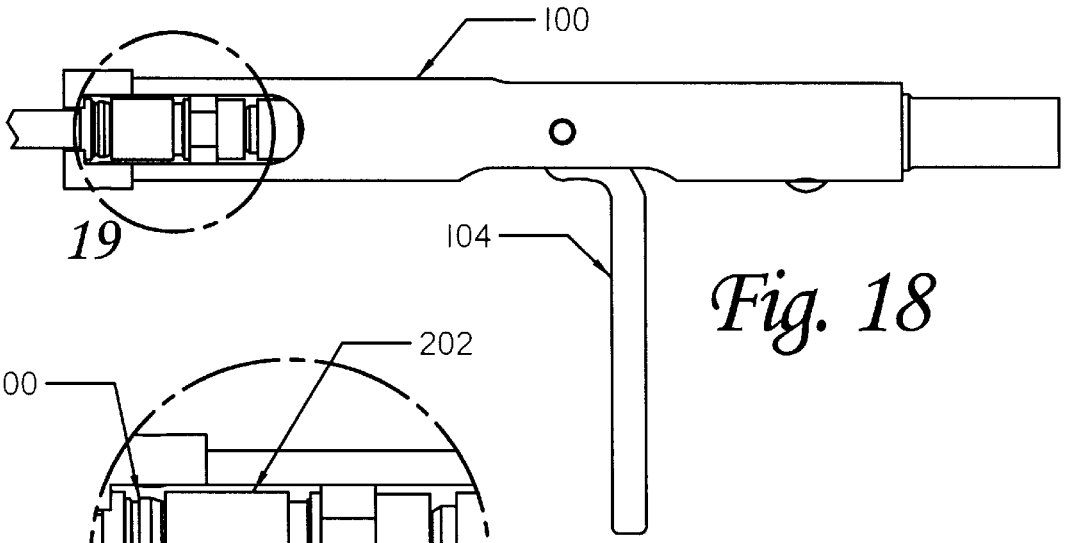
FIG. 18 shows the fitting in place in the tool ready for compression.
Figure 19:
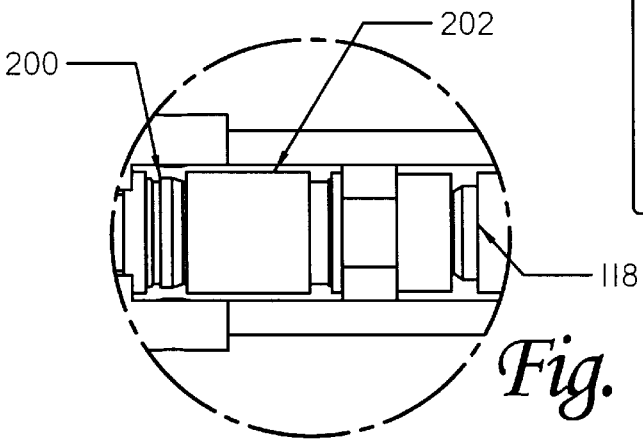
FIG. 19 is a detailed view of the fitting within the tool as in FIG. 18.

FIGS. 18 & 19 shows the fitting in position within the cavity, 122, of the tool with the handle, 104, in the open position and the compression plunger retracted. The sleeve, 200, and body, 202, have been loosely mated by sliding the sleeve into the body of the fitting with light finger pressure. This reduces the length of the uncompressed fitting allowing the use of a shorter stroke on the compression tool.

Figure 20:
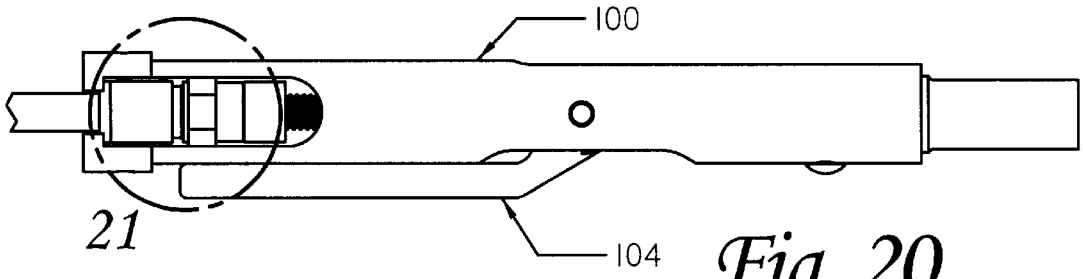
FIG. 20 shows the fitting in place in the tool after compression.
Figure 21:
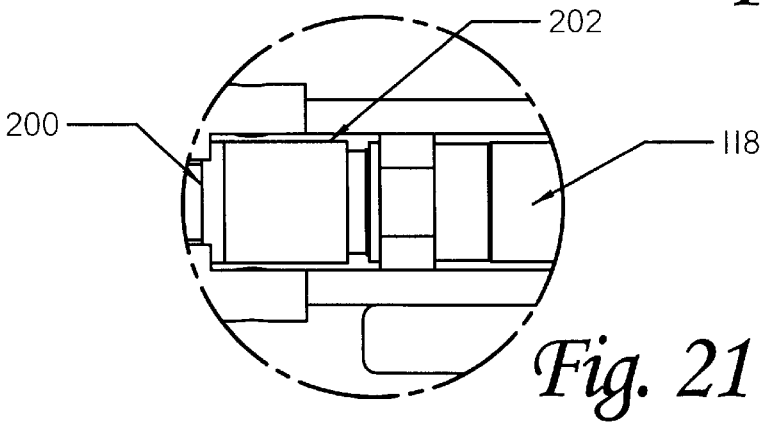
FIG. 21 is a detailed view of the fitting within the tool as in FIG. 20.

FIGS. 20 and 21 illustrate the tool and fitting after the compression stroke. The head, 8, has moved into contact with the body, 202, of the fitting and then continued to force the body over the sleeve, 200, locking the sleeve and cable in place. The operation and method of compressing the fitting are well known in the industry and are summarized here to clarify the operation of the compression component of the inventive tool.

Alternative Embodiments

A variety of alternative embodiments are readily derived without departing from the principles of the invention. Among those are the embodiments illustrated,if FIGS. 14–16.

Figure 14:
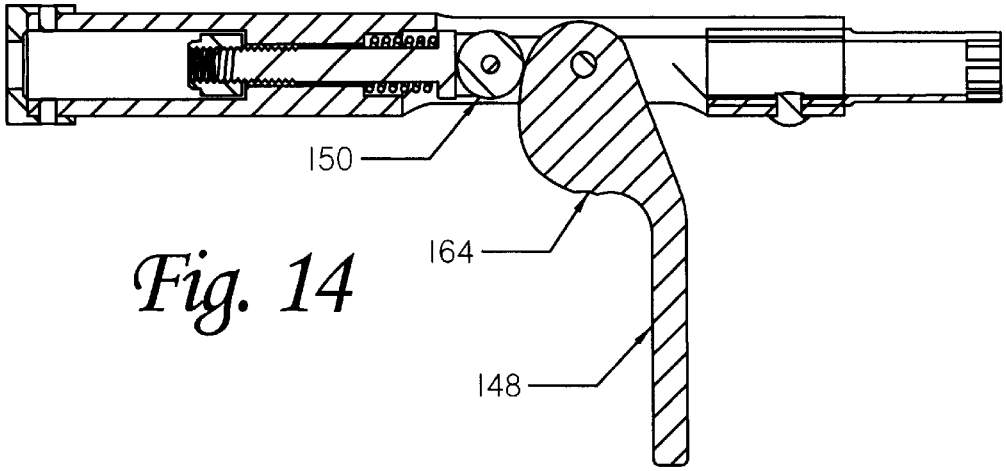
FIG. 14 is a cross section through an alternative embodiment of the tool, along the same line as FIG. 5, illustrating the roller and modified cam profile.

The embodiment of FIG. 14 utilizes a roller, 150, mounted to the end of the plunger which then bears on the cam portion of handle, 148. The roller reduces friction between the handle and the plunger while the profile of the handle has been altered to take advantage of the roller and to provide different performance. The initial profile is quite steep, resulting in rapid movement of the plunger toward the fitting to initially bring the head into contact with the fitting. The profile then becomes more gradual to provide increased mechanical advantage for increased pressure on the fitting with reduced pressure required on the handle. Notch, 164, engages the roller when the handle is in the closed position to hold the handle in place. In all other ways this embodiment is the same as the preferred embodiment.

Figure 15:
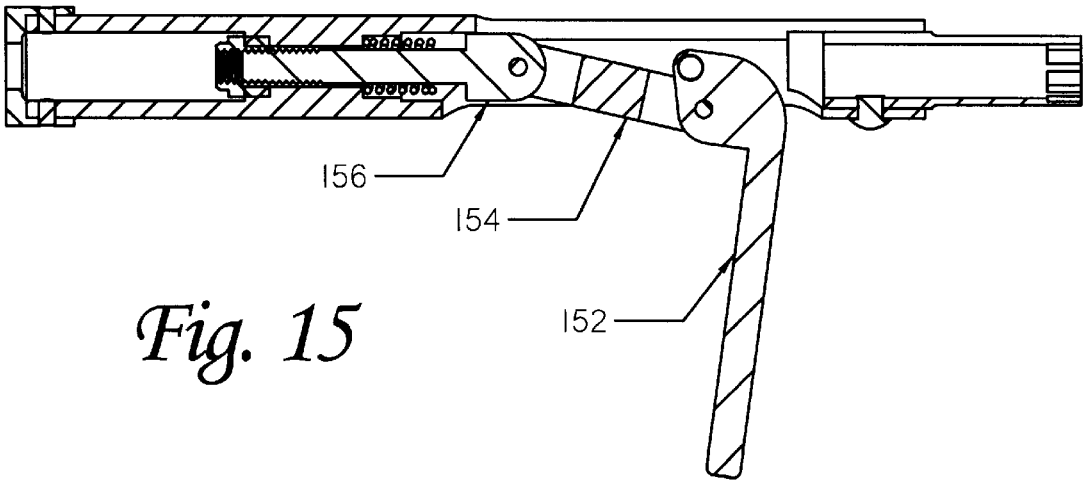
FIG. 15 is a cross section through another alternative embodiment of the tool, along the same line as FIG. 5, illustrating the link and handle.

FIG. 15 illustrates an embodiment which utilizes a connecting link, 154, and a modified plunger, 156, to connect to the handle, 152. This provides substantially the same performance as the preferred embodiment, although with a greater parts count and without flexibility afforded by the ability to adjust the cam profile in the above and preferred embodiments.

Figure 16:
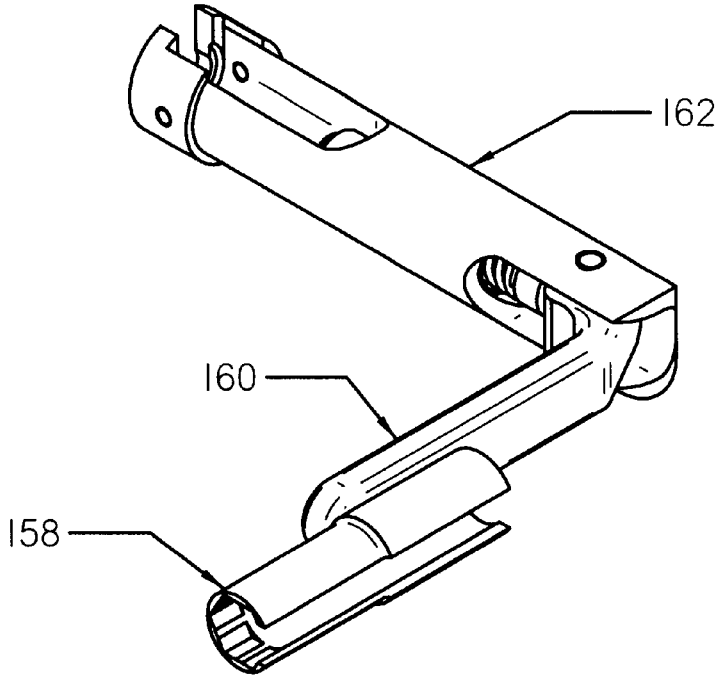
FIG. 16 illustrates a further alternative embodiment of the tool in which a security sleeve wrench is attached to the handle rather than the body of the tool.

In the embodiment of FIG. 16, the security sleeve wrench, 158, has been attached to the handle, 160, and the body, 162, of the tool truncated. This approach can be combined with any of the above embodiments, and results in a shorter, wider tool which may be preferable to some users. If desired, the handle, and attached wrench, may be fully extended into alignment with the body of the tool.

While the preferred form of the invention has been disclosed above, alternative methods of practicing the invention are readily apparent to the skilled practitioner. The above description of the preferred embodiment is intended to be illustrative only and not to limit the scope of the invention.

What is claimed is:

1. A multi-function tool adapted to perform two or more operations on a coaxial cable fitting, said tool comprising: a linear compression tool adapted to install the coaxial cable fitting; a first wrench selected from the group consisting of trap wrench, security sleeve wrench, and hex socket wrench; and an activating handle capable of being positioned substantially perpendicular to said multifunction tool whereby it is usable as a lever to apply greater torque to said wrench.

2. A multi-function tool adapted to perform two or more operations on a coaxial cable fitting, said tool comprising: a linear compression tool adapted to install the coaxial cable fitting; and a first wrench selected from the group consisting of trap wrench, security sleeve wrench, and hex socket wrench, said wrench removably attached to said compression tool to accommodate replacement and said wrench further comprising a seat for said compression tool whereby replacement of this single part effects the replacement of both said wrench and said seat.

3. A multi-function tool adapted to perform two or more operations on a coaxial cable fitting, said tool comprising: a linear compression tool adapted to install the coaxial cable fitting; a first wrench selected from the group consisting of trap wrench, security sleeve wrench, and hex socket wrench; and a second unique wrench selected from the group consisting of trap wrench, security sleeve wrench, and hex socket wrench.

4. The multi-function tool of claim 3 wherein both of said wrenches are removably attached to said compression tool to accommodate replacement.

5. The multi-function tool of claim 3 wherein said first and second wrenches are attached to said compression tool at opposing ends.

6. The multi-function tool of claim 5 wherein said compression tool comprises an activating handle capable of being positioned substantially perpendicular to said multifunction tool whereby it is usable as a lever to apply greater torque to said wrenches and said handle is positioned at substantially equal distance from each of said wrenches.

7. The multi-function tool of claim 3 further combined with a third unique wrench selected from the group consisting of trap wrench, security sleeve wrench, and hex socket wrench.

8. The multi-function tool of claim 7 wherein each of said wrenches has an axis about which it rotates when operated and the axes of at least two of said wrenches are aligned.

9. The multi-function tool of claim 8 wherein each of said wrenches has a face, normal to its axis, and the faces of said wrenches having aligned axes are coplanar.

10. An installation tool for a coaxial cable fitting comprising:

(a) a common body;

(b) compression tool comprising:

(i) a handle, pivotally mounted to said body;

(ii) a plunger, activated by said handle, slideably received in said body;

(iii) a head, connected to said plunger, adapted to engage the fitting;

(iv) a seat, mounted to said body in alignment with said plunger, comprising a beveled recess adapted to receive the fitting, said bevel encompassing more than 180 degrees of said recess;

(c) a first wrench, mounted to said body, selected from the group consisting of trap wrench, security sleeve wrench, and hex socket wrench.

11. The installation tool of claim 10 wherein said body is cylindrical with a longitudinal axis and said plunger is substantially aligned with said longitudinal axis and said wrench rotates about said longitudinal axis when operated.

12. The installation tool of claim 11 further combined with a second wrench selected from the group consisting of trap wrench, security sleeve wrench, and hex socket wrench, said second wrench rotating about said longitudinal axis when operated.

13. The installation tool of claim 12 wherein said first and second wrenches are attached to said compression tool at opposing ends.

14. The installation tool of claim 13 further combined with a third wrench selected from the group consisting of trap wrench, security sleeve wrench, and hex socket wrench and wherein at least two of said wrenches are attached at the same end of said body and rotate about the same axis when operated.

15. The installation tool of claim 14 further comprising a removable end attached to said body, said removable end comprising at least one of said wrenches and said compression tool seat whereby replacement of said removable end effects the replacement of both said wrench and said seat.

16. The installation tool of claim 10 wherein said body defines a slot in the surface thereof and said handle moves between a first open position and a second closed position and when in said closed position is received in said slot so that it is at least partially recessed into said body.

17. The installation tool of claim 16 wherein said handle, when in said closed position, is substantially flush with the outer surface of said body.

* * * * *